US007928957B2

(12) United States Patent
Tsuchida et al.

(10) Patent No.: US 7,928,957 B2
(45) Date of Patent: Apr. 19, 2011

(54) LIGHT-EMISSION CONTROL DEVICE AND LIQUID-CRYSTAL DISPLAY APPARATUS

(75) Inventors: Masaki Tsuchida, Tokyo (JP); Ken Ito, Kanagawa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 140 days.

(21) Appl. No.: 12/327,746

(22) Filed: Dec. 3, 2008

(65) Prior Publication Data

US 2009/0290091 A1 Nov. 26, 2009

(30) Foreign Application Priority Data

May 26, 2008 (JP) ..... 2008-136875

(51) Int. Cl.
*G09G 3/36* (2006.01)

(52) U.S. Cl. ..... 345/102; 345/87

(58) Field of Classification Search ..... 345/60, 345/82, 84, 87, 102, 98–100, 204; 349/61
See application file for complete search history.

(56) References Cited

U.S. PATENT DOCUMENTS

| | | | |
|---|---|---|---|
| 5,818,172 | A | 10/1998 | Lee |
| 6,353,291 | B1 | 3/2002 | Borgogno et al. |
| 7,113,164 | B1 | 9/2006 | Kurihara |
| 7,292,221 | B2 | 11/2007 | Woo |
| 7,342,577 | B2 | 3/2008 | Struebel et al. |
| 2006/0007103 | A1 | 1/2006 | Oh et al. |
| 2006/0103621 | A1 | 5/2006 | Feng |
| 2006/0214904 | A1 | 9/2006 | Kimura et al. |
| 2006/0238487 | A1 | 10/2006 | Shih |
| 2006/0284824 | A1 | 12/2006 | Yeh |
| 2008/0111784 | A1 | 5/2008 | Tanaka et al. |

FOREIGN PATENT DOCUMENTS

| | | |
|---|---|---|
| JP | 2002-099250 | 4/2002 |
| JP | 2004-191490 | 7/2004 |
| JP | 2005-338857 | 12/2005 |
| JP | 2007-034251 | 2/2007 |
| JP | 2007-219234 | 8/2007 |
| JP | 2007-279395 | 10/2007 |
| JP | 2008-020611 | 1/2008 |
| WO | WO2007141721 | 12/2007 |

OTHER PUBLICATIONS

Search Report for corresponding European Application No. 08021461.2-1228 mailed Mar. 13, 2009.

*Primary Examiner* — Regina Liang
(74) *Attorney, Agent, or Firm* — Blakely, Sokoloff, Taylor & Zafman LLP

(57) ABSTRACT

According to one embodiment, a light-emission control device controls light emission of light sources of a light emitter including a plurality of light source areas each corresponding to one of the light sources, and includes a light-value calculator, a light-value modifying module, and a light controller. The light-value calculator calculates a light value for each of the light source areas. The light source areas include a target area for which a light value is to be modified and surrounding areas surrounding the target area. The light-value modifying module modifies a light value calculated for the target area using light values for the surrounding areas. The light controller lights a light source in the target area based on the modified light value.

11 Claims, 9 Drawing Sheets

LIGHT-EMISSION CONTROL DEVICE AND LIQUID-CRYSTAL DISPLAY APPARATUS

CROSS-REFERENCE TO RELATED APPLICATIONS

This application is based upon and claims the benefit of priority from Japanese Patent Application No. 2008-136875, filed May 26, 2008, the entire contents of which are incorporated herein by reference.

BACKGROUND

1. Field

One embodiment of the invention relates to a light-emission control device that controls light emission of a light emitter, and a liquid-crystal display apparatus with the light-emission control device.

2. Description of the Related Art

Currently available televisions, personal computers, mobile phones, etc. are generally equipped with a liquid-crystal display apparatus that displays images. Such a liquid-crystal display apparatus includes a liquid crystal panel, which by itself does not emit light but is illuminated by a light emitter, such as a backlight, located behind it.

Some conventional liquid-crystal display apparatuses with backlight are configured with a view to reducing power consumption. In such a configuration, the display screen is associated with light sources that constitute the backlight and divided into a plurality of areas (screen areas), and the light sources are controlled area by area.

Among this type of liquid-crystal display apparatuses is the one disclosed in Japanese Patent Application Publication (KOKAI) No. 2004-191490. This liquid-crystal display apparatus calculates the maximum luminance of each screen area based on input video signal, and causes the light source in each screen area to emit light based on the maximum luminance, and corrects luminance information supplied to a liquid crystal panel.

In a liquid-crystal display apparatus that controls the light sources area by area, a light value at which each light source is lit and the transmittance of each liquid crystal element forming the liquid crystal panel are correlated to control the luminance of the liquid crystal panel to a desired value.

However, even if the light value at which each light source is lit and the transmittance of each liquid crystal element of the liquid-crystal panel are correlated, a video image with sharp brightness variation (e.g., a video image which is predominantly dark with a small area of light) cannot be displayed with appropriate luminance, or the displayed video image may flicker.

BRIEF DESCRIPTION OF THE SEVERAL VIEWS OF THE DRAWINGS

A general architecture that implements the various features of the invention will now be described with reference to the drawings. The drawings and the associated descriptions are provided to illustrate embodiments of the invention and not to limit the scope of the invention.

DETAILED DESCRIPTION

Various embodiments according to the invention will be described hereinafter with reference to the accompanying drawings. In general, according to one embodiment of the invention, a light-emission control device controls light emission of a plurality of light sources of a light emitter that illuminates a liquid crystal panel and that includes a plurality of light source areas in each of which is arranged one of the light sources. The light-emission control device includes: a light-value calculator configured to calculate a light value of each of the light sources for each of the light source areas; a light-value modifying module configured to modify a light value calculated by the light-value calculator for a target area to a modified light value using light values for surrounding areas, the target area being one of the light source areas for which a light value is to be modified, and the surrounding areas being light source areas around the target area; and a light controller configured to light a light source in the target area based on the modified light value.

According to another embodiment, a liquid-crystal display apparatus includes a liquid crystal panel, a light emitter that includes a plurality of light source areas in each of which is arranged one of a plurality of light sources for illuminating the liquid crystal panel, and a light-emission control device that controls light emission of the light sources. The liquid-crystal display apparatus further includes: a light-value calculator configured to calculate a light value of each of the light sources for each of the light source areas; a light-value modifying module configured to modify a light value calculated by the light-value calculator for a target area to a modified light value using light values for surrounding areas, the target area being one of the light source areas for which a light value is to be modified, and the surrounding areas being light source areas around the target area; and a light controller configured to light a light source in the target area based on the modified light value.

Figure 1:
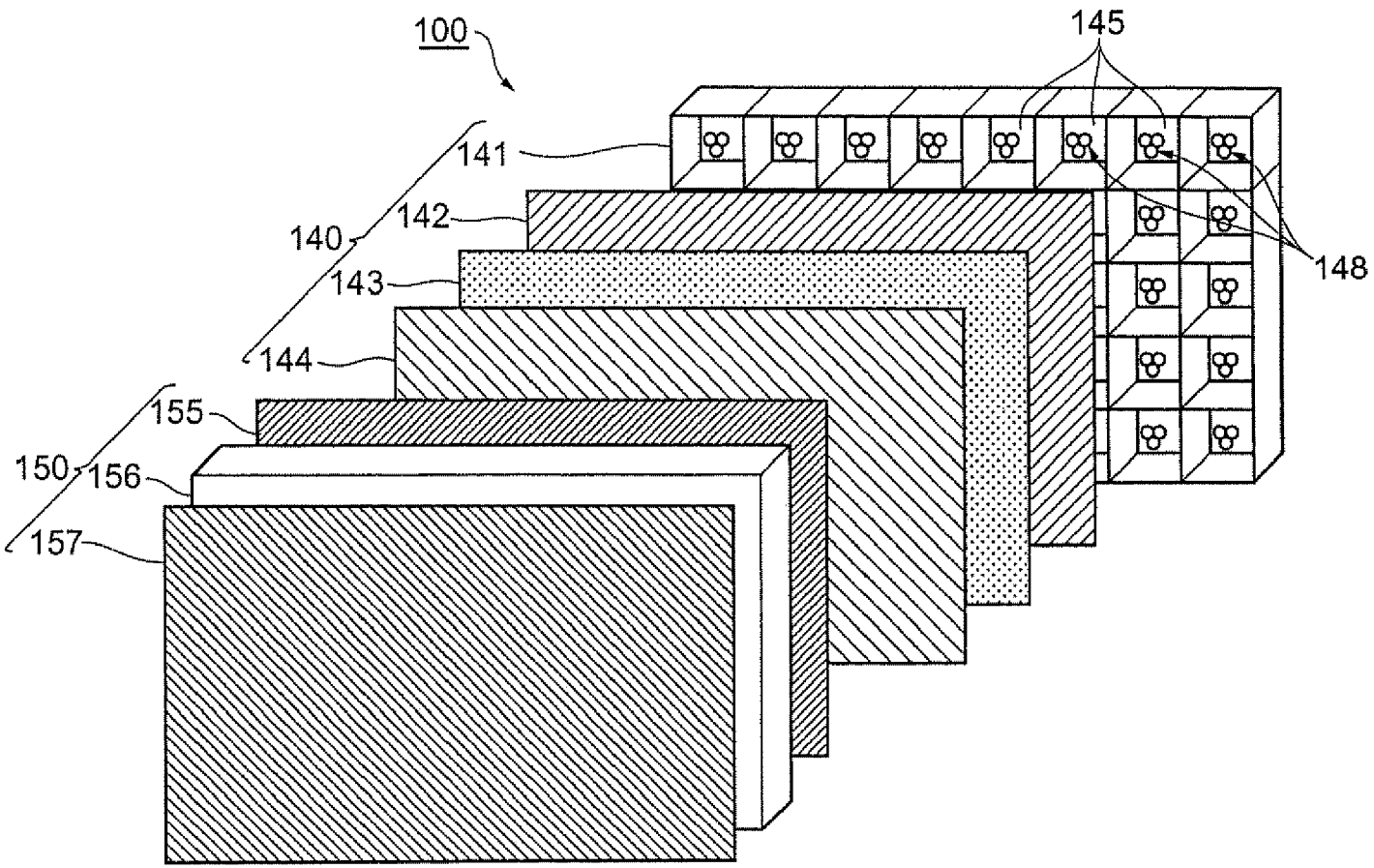
FIG. 1 is an exemplary exploded perspective view of a liquid-crystal display apparatus according to an embodiment of the invention.
Figure 2:
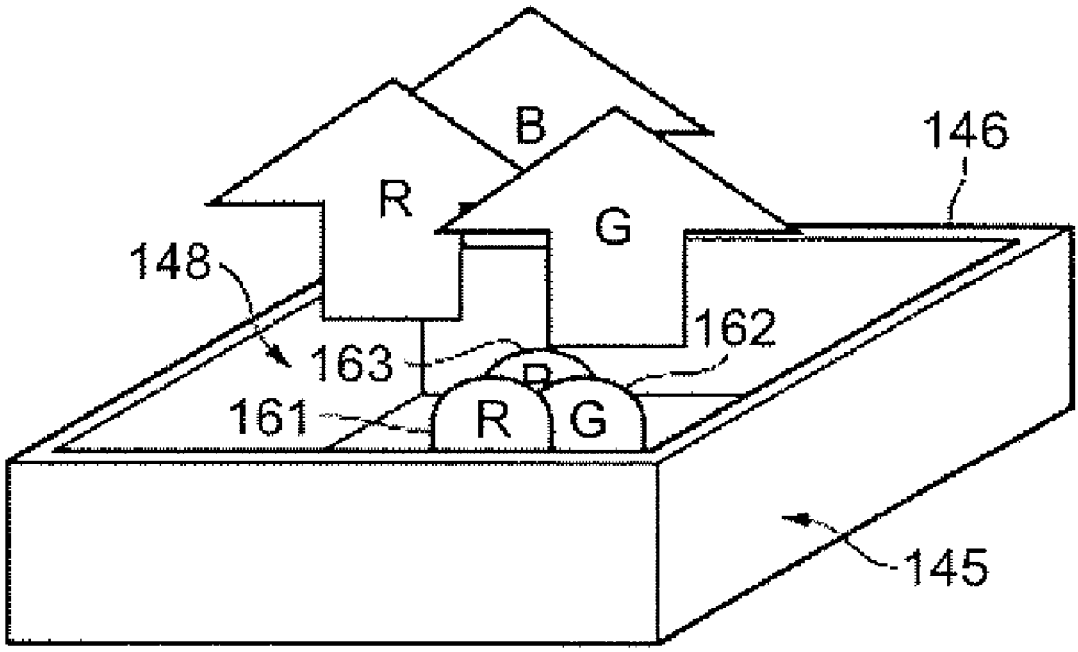
FIG. 2 is an exemplary perspective view of a light source area and a light source in the embodiment.

A configuration of a liquid-crystal display apparatus 100 according to an embodiment of the invention is explained below with reference to FIGS. 1 and 2. FIG. 1 is an exploded perspective view of the liquid-crystal display apparatus 100. FIG. 2 is a perspective view of a light source area and a light source.

The liquid-crystal display apparatus 100, used in a liquid crystal television, etc., includes a backlight 140 and a liquid crystal panel 150 as illustrated in FIG. 1.

The backlight 140 that functions as a light emitter and includes a light emitter 141, a prism sheet 143 disposed in front of the light emitter 141, and a pair of diffusion plates 142 and 144 with the prism sheet 143 in between them.

The light emitter 141 is in the form of a panel having a plurality of light source areas 145 arranged regularly in a matrix of M rows and N columns. In FIG. 1, the light source areas 145 of the light emitter 141 are arranged in a matrix of, for example, five rows and eight columns.

As can be seen from FIG. 2, each of the light source areas 145 is enclosed on four sides by partition walls 146 that extend in the direction of the diffusion plate 142.

Each of the light source area 145 includes a light source 148 formed of light emitting devices (LEDs) 161 to 163 corresponding to the three primary colors of red, green, and blue (RGB), respectively. The light source 148 emits a mixed light of red, green, and blue from the red LED 161, the green LED 162, and the blue LED 163, respectively, toward the front (i.e., toward the liquid crystal panel 150). The back surface of the liquid crystal panel 150 is illuminated by the light emitted from the light source areas 145, and the transmittance thereof is adjusted to display an image.

The liquid-crystal display apparatus 100 is of direct backlight type in which the entire surface of the backlight 140 emits light from the light sources 148 of the light source areas 145, thereby illuminating the liquid crystal panel 150 from the back.

The liquid crystal panel 150 includes a pair of polarizing plates 155 and 157, and a liquid crystal cell 156 disposed between the polarizing plates 155 and 157.

Figure 3:
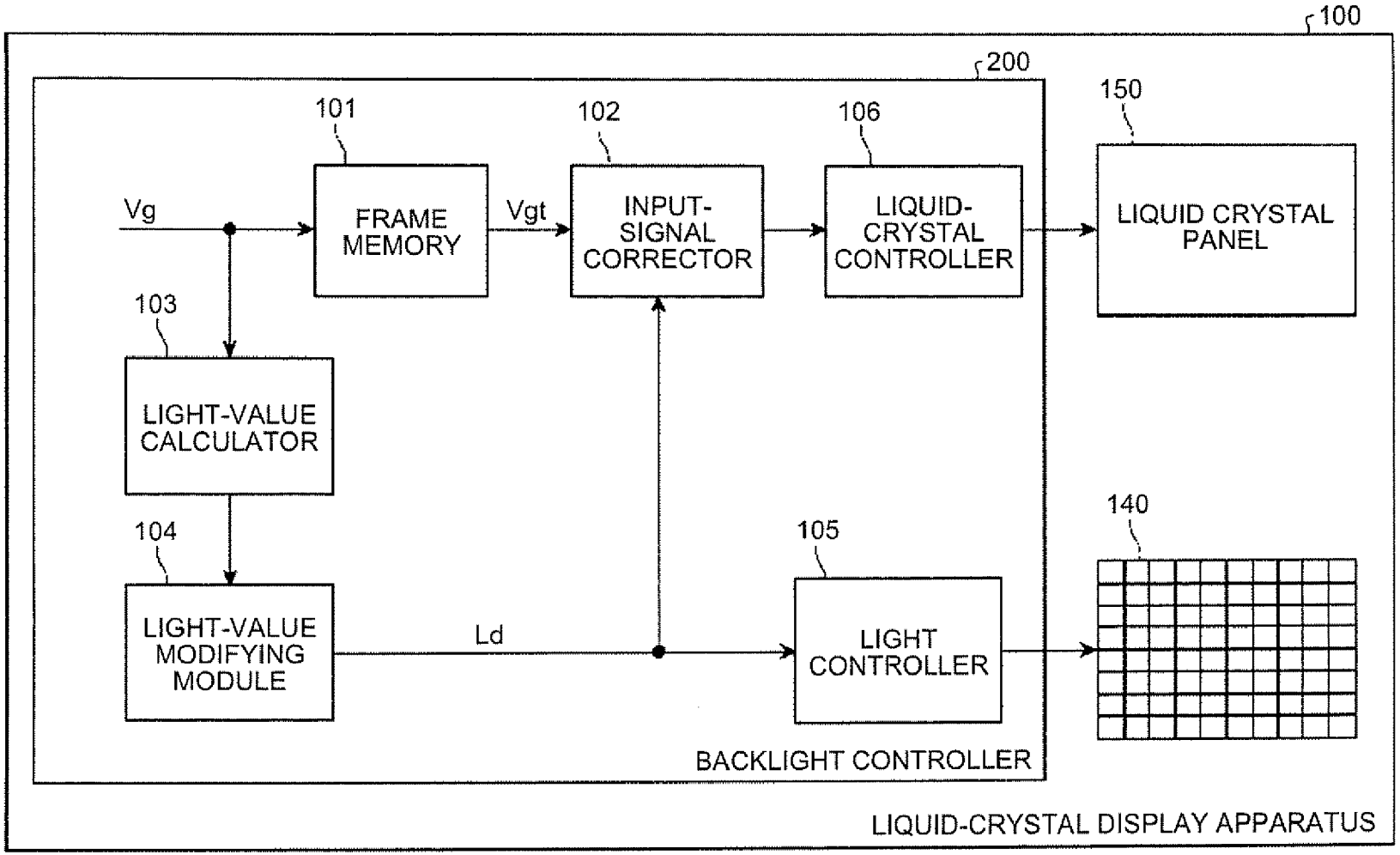
FIG. 3 is an exemplary block diagram of a backlight controller together with a backlight and a liquid crystal panel in the embodiment.

A backlight controller 200 is explained below with reference to FIG. 3. FIG. 3 is a block diagram of the backlight controller 200 together with the backlight 140 and the liquid crystal panel 150.

In addition to the backlight 140 and the liquid crystal panel 150, the backlight controller 200 is provided to the liquid-crystal display apparatus 100. The backlight controller 200 functions as a light-emission control device that controls the light emitted by the light sources 148 of the backlight 140.

The backlight controller 200 includes a frame memory 101, an input-signal corrector 102, a light-value calculator 103, a light-value modifying module 104, a light controller 105, and a liquid crystal controller 106.

The backlight controller 200 receives a video signal Vg required for displaying a video image on the liquid crystal panel 150.

In the backlight controller 200, the video signal Vg is supplied to the frame memory 101 and the light-value calculator 103. The frame memory 101 stores therein the video signal Vg for every frame. The input-signal corrector 102 corrects a video signal Vgt read from the frame memory 101 based on a modified light value Ld modified by the light-value modifying module 104, described later, and outputs it to the liquid crystal controller 106. When correcting the video signal Vgt read from the frame memory 101, the input-signal corrector 102 establishes a correlation between the video signal Vgt and the modified light value Ld. The liquid crystal controller 106 controls the transmittance of the liquid crystal panel 150 based on the corrected video signal Vgt. The backlight controller 200 appropriately matches the timing of displaying an image by the liquid crystal panel 150 with the timing of turning on the light sources 148.

The light-value calculator 103 calculates, based on the video signal Vg, a light value Ld0 of the light source 148 in each of the light source areas 145, and the light-value modifying module 104 modifies the light value Ld0 to the modified light value Ld. The light controller 105 lights the light source 148 in each of the light source areas 145 based on the modified light value Ld to emit light from the backlight 140.

Figure 4:
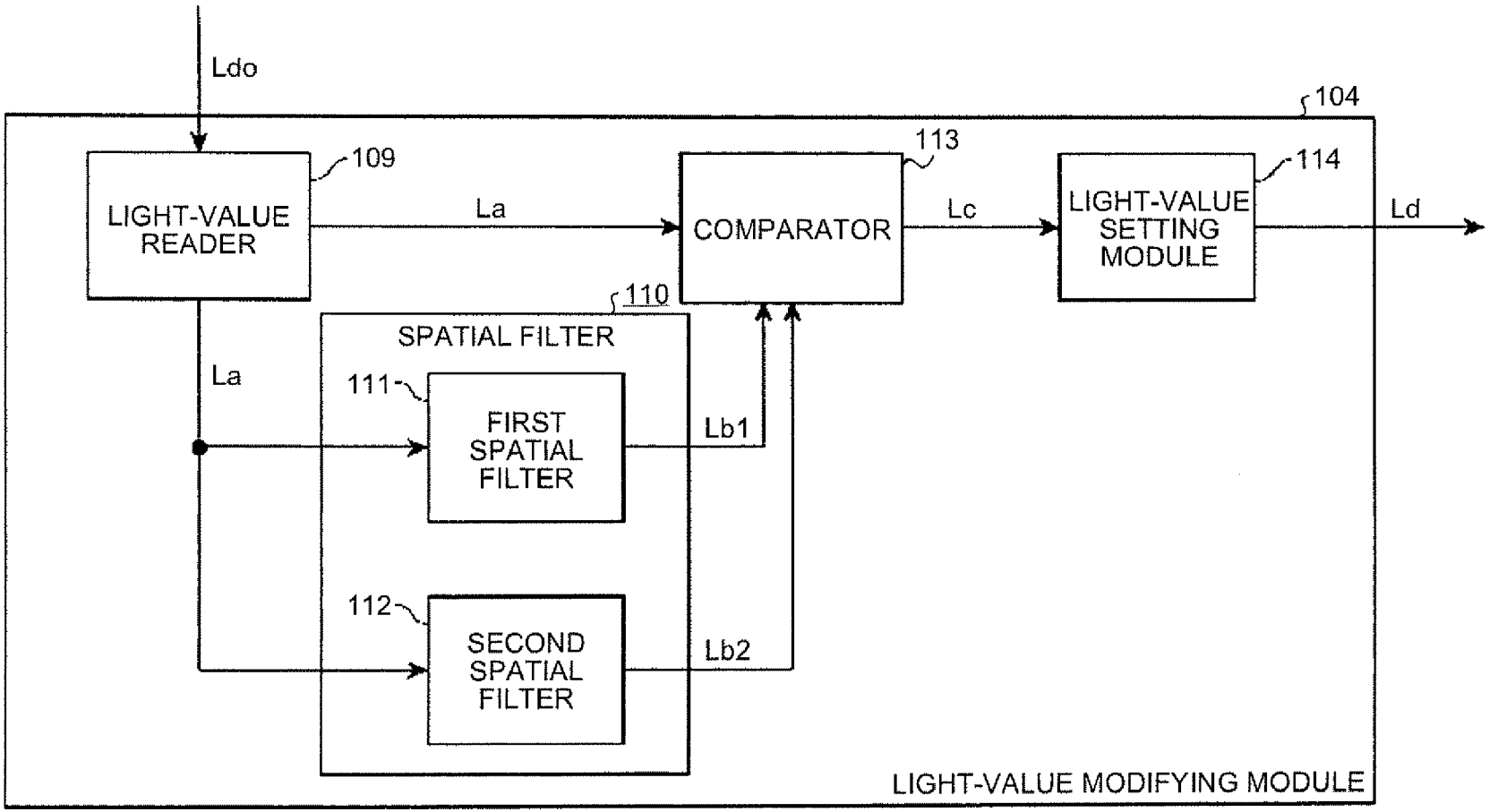
FIG. 4 is an exemplary block diagram of a light-value modifying module in the embodiment.

A configuration of the light-value modifying module 104 is explained below with reference to FIG. 4. FIG. 4 is a block diagram of the light-value modifying module 104. The light-value modifying module 104 includes a light-value reader 109, a spatial filter 110, a comparator 113, and a light-value setting module 114. Each of the constituent modules is described below with the operation of the light-value modifying module 104.

The operation of the backlight controller 200 configured as above is described below with reference to FIGS. 5 to 8 with particular reference to the operation of the light-value modifying module 104.

The light-value reader 109 reads the light value Ld0 of the light source 148 in each of the light source areas 145 calculated by the light-value calculator 103. The light value Ld0 read by the light-value reader 109, referred to as "read light value La", is input to the spatial filter 110.

The spatial filter 110 includes a first spatial filter 111 and a second spatial filter 112. Both the first spatial filter 111 and the second spatial filter 112 perform spatial filtering on the read light value La of the light source area 145 for which light-value modification is to be performed (target area), and on the read light value La of the light source areas 145 surrounding the target area (surrounding areas). The first spatial filter 111 and the second spatial filter 112 perform spatial filtering based on predetermined modification parameters, and output filtered light values Lb1 and Lb2, respectively.

Upon receipt of the filtered light values Lb1 and Lb2, the comparator 113 compares the light values La of the target area and the surrounding areas with the filtered light values Lb1 and Lb2 and, based on the comparison result, outputs a set light value Lc, described later. The set light value Lc is input to the light-value setting module 114.

The light-value setting module 114 sets the modified light value Ld based on the set light value Lc and outputs the modified light value Ld to the light controller 105. Although the spatial filter 110 is described as, for example, having two spatial filters (the first spatial filter 111 and the second spatial filter 112) it can have three or more spatial filters.

Figure 5:
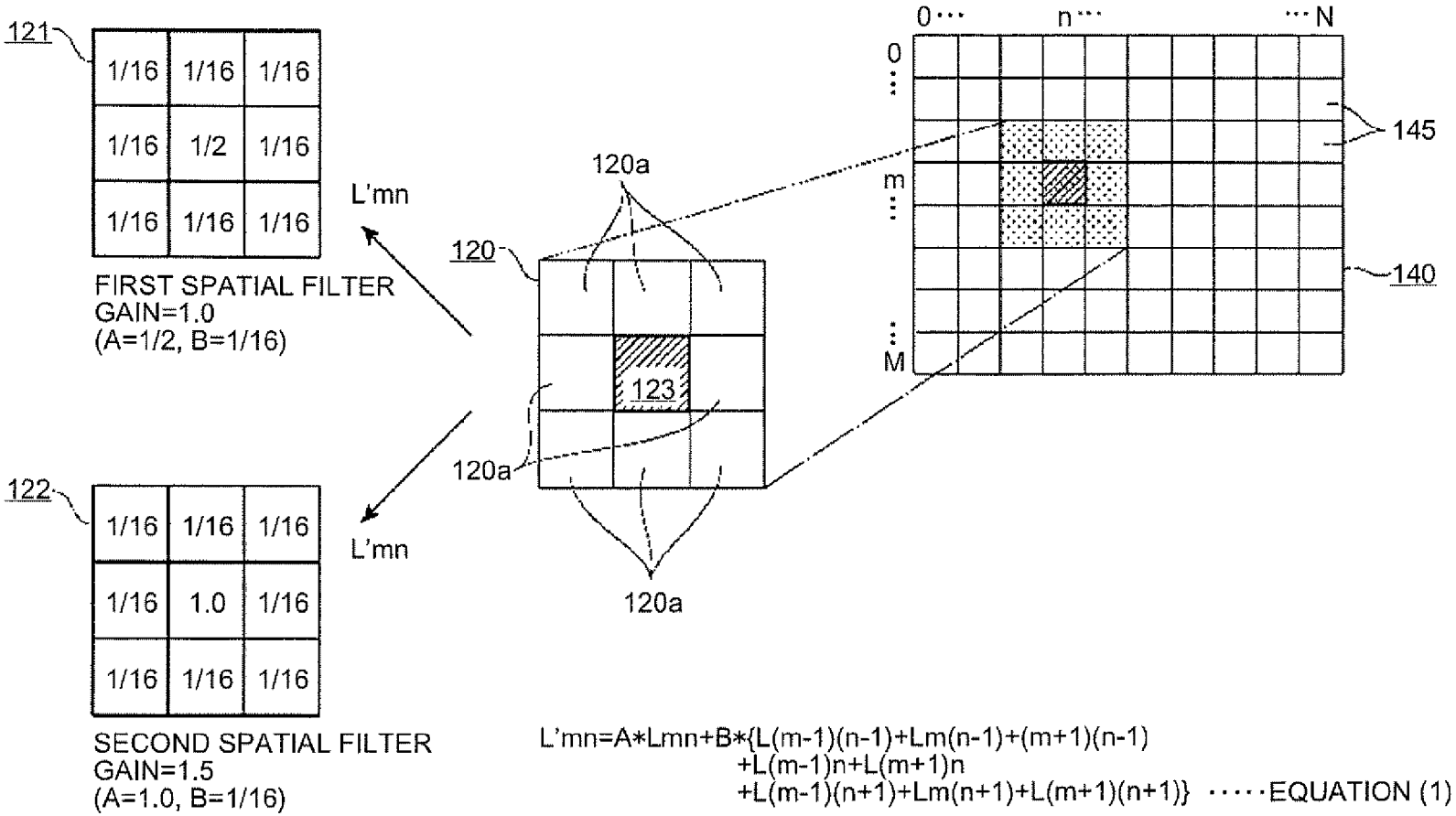
FIG. 5 is an exemplary schematic diagram illustrating the operation of the light-value modifying module in the embodiment.

The operation of the spatial filter 110 is explained in detail below with reference to FIG. 5. As illustrated in FIG. 5, among M rows and N columns of the light source areas 145, i.e., the M×N light source areas 145 forming the backlight 140, the light source area 145 at a position mn is taken as a target area 123. The target area 123 is surrounded by eight light source areas 145 as surrounding areas 120*a*. The spatial filter 110 performs spatial filtering on the read light value La of the target area 123 and the read light value La of the eight surrounding areas 120*a*. In the present embodiment, the target area 123 and the eight surrounding areas 120*a* are collectively referred to as a filter area 120.

When no filtering is performed by the spatial filter 110, the light value of the target area 123 remains unchanged at a gain of 1.0.

The first spatial filter 111 is described first. To obtain a gain of 1.0, the first spatial filter 111 sets an input light value (the read light value La of the target area 123) to ½ and adds 1/16 of the read light value La of the surrounding areas 120*a* to the input light value. By doing so, the first spatial filter 111 ensures a light value of the same magnitude as that of the target area 123 using the light value of the entire filter area 120. The first spatial filter 111 performs filtering by modifying the light value according to modification parameters 121 of FIG. 5.

Due to limitations in the light intensity of the light source 148, when a video image is displayed in which a specific portion is particularly bright, it may not be possible to brighten the specific portion to the desired level by the light from the light source area 145 corresponding thereto. The first spatial filter 111 of the light-value modifying module 104 modifies the light value by filtering so that the light sources 148 of the surrounding areas 120*a* light more brightly to compensate for the shortage of light intensity.

The first spatial filter 111 modifies the light value using Equation (1) as follows:

$$L'mn=A\times Lmn+B\times\{L(m-1)(n-1)+Lm(n-1)+L(m+1)(n-1)+L(m-1)n+L(m+1)n+L(m-1)(n+1)+Lm(n+1)+L(m+1)(n+1)\} \quad (1)$$

where A is the modification parameter of the target area 123 and B is the modification parameter of the surrounding areas 120*a*.

Because the gain of the first spatial filter 111 is 1.0, the light energy of the entire filter area 120 remains the same for all video images. In other words, the brightness and the power consumption remain the same as before filtering.

For example, in a video image in which a white ball is moving horizontally against the black background, the light sources 148 of the light source areas 145 sequentially turn on and off as the ball moves. This turning on/off of the light sources 148 causes the video image to flicker. However, filtering with the first spatial filter 111 suppresses abrupt changes in brightness, thereby achieving a smooth change of luminance. Thus, it is possible to enhance the dynamic characteristics of the video display and reduce flicker.

However, if the surrounding areas 120*a* used for compensating for insufficient brightness are dark, desired brightness cannot be achieved by addition of 1/16 of the light values of the surrounding areas 120*a*. If luminance is measured partly, luminance may decrease by filtering with the first spatial filter 111. For this reason, the light-value modifying module 104 is provided with the second spatial filter 112.

Modification parameters 122 for the second spatial filter 112 are set to achieve a gain of 1.5. The second spatial filter 112 uses the same Equation (1) given above. The second spatial filter 112 differs from the first spatial filter 111 in that the light value of the target area 123 remains unchanged.

Because the gain of the second spatial filter 112 is 1.5, the brightness of the filter area 120 increases compared to the light value before filtering. Therefore, more power is consumed due to filtering by the second spatial filter 112. This is explained with reference to FIG. 6.

Figure 6:
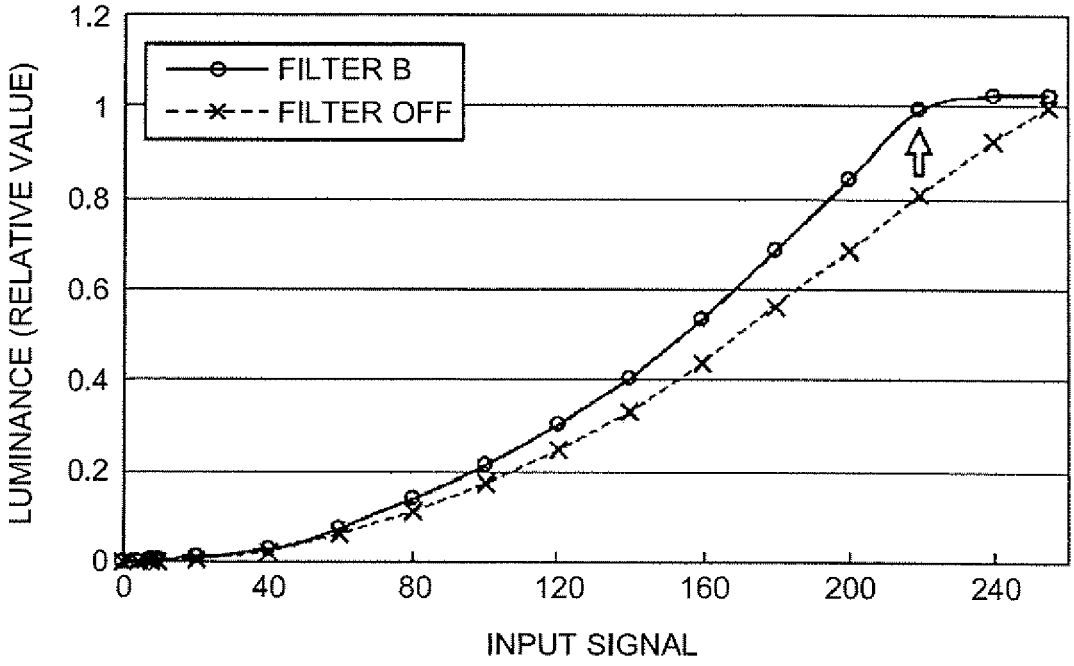
FIG. 6 is an exemplary graph comparing the luminance of the liquid crystal panel in 100% (full) white display mode between when filter is OFF and after filtering is performed by a second spatial filter in the embodiment.

FIG. 6 is a graph comparing the luminance of the liquid crystal panel 150 in 100% (full) white display mode (a full-white screen) between when no filtering is performed (when filter is OFF) and after filtering is performed by the second spatial filter 112. The vertical axis represents the luminance of the liquid crystal panel 150, and the horizontal axis represents the input video signal. It can be seen from FIG. 6 that the overall brightness increases when filtering is performed by the second spatial filter 112. Meanwhile, it can also be seen from FIG. 6 that saturation of luminance is reached when input video signals exceed 200. This indicates unnecessary increase in brightness and wasteful power consumption.

As described above, if filtering is performed by only the first spatial filter 111 with a gain of 1.0, it is possible to achieve a smooth change of surrounding luminance without increasing power consumption, and thus to enhance the dynamic characteristics as well as to reduce flicker in a video image with sharp brightness variation. In this case, however, the overall luminance may decrease.

On the other hand, if filtering is performed by only the second spatial filter 112 with a gain of 1.5, the luminance can be increased; however, power is wastefully consumed when filtering is always performed with a gain of 1.5.

Therefore, the light-value modifying module 104 is provided with the first spatial filter 111 and the second spatial filter 112, and selectively switches between the two. Consequently, luminance shortage can be eliminated without wasteful power consumption.

Figure 7:
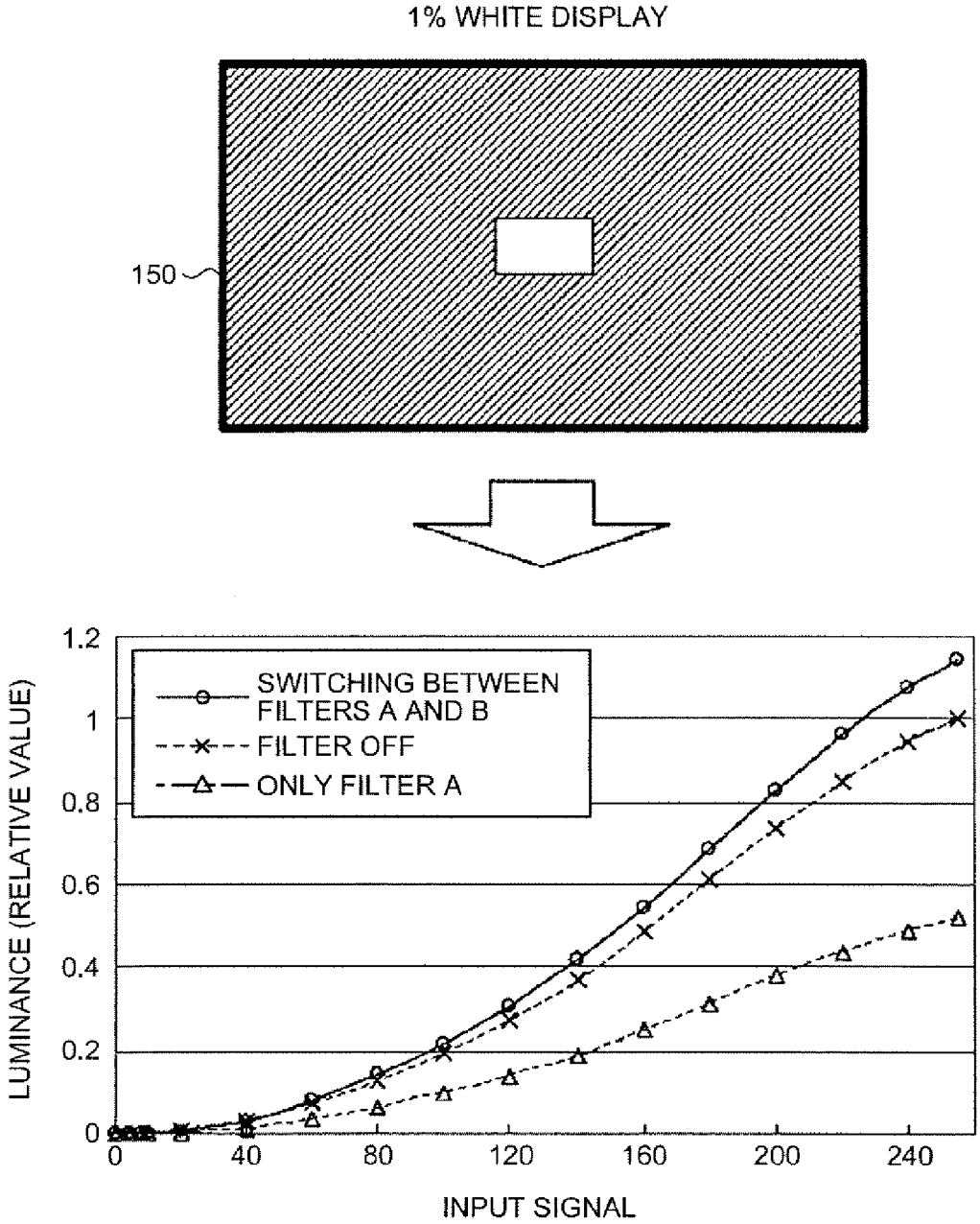
FIG. 7 is an exemplary graph comparing the luminance of the liquid crystal panel in 1% white display mode when selective switching is performed between a first spatial filter and the second spatial filter in the embodiment.
Figure 8:
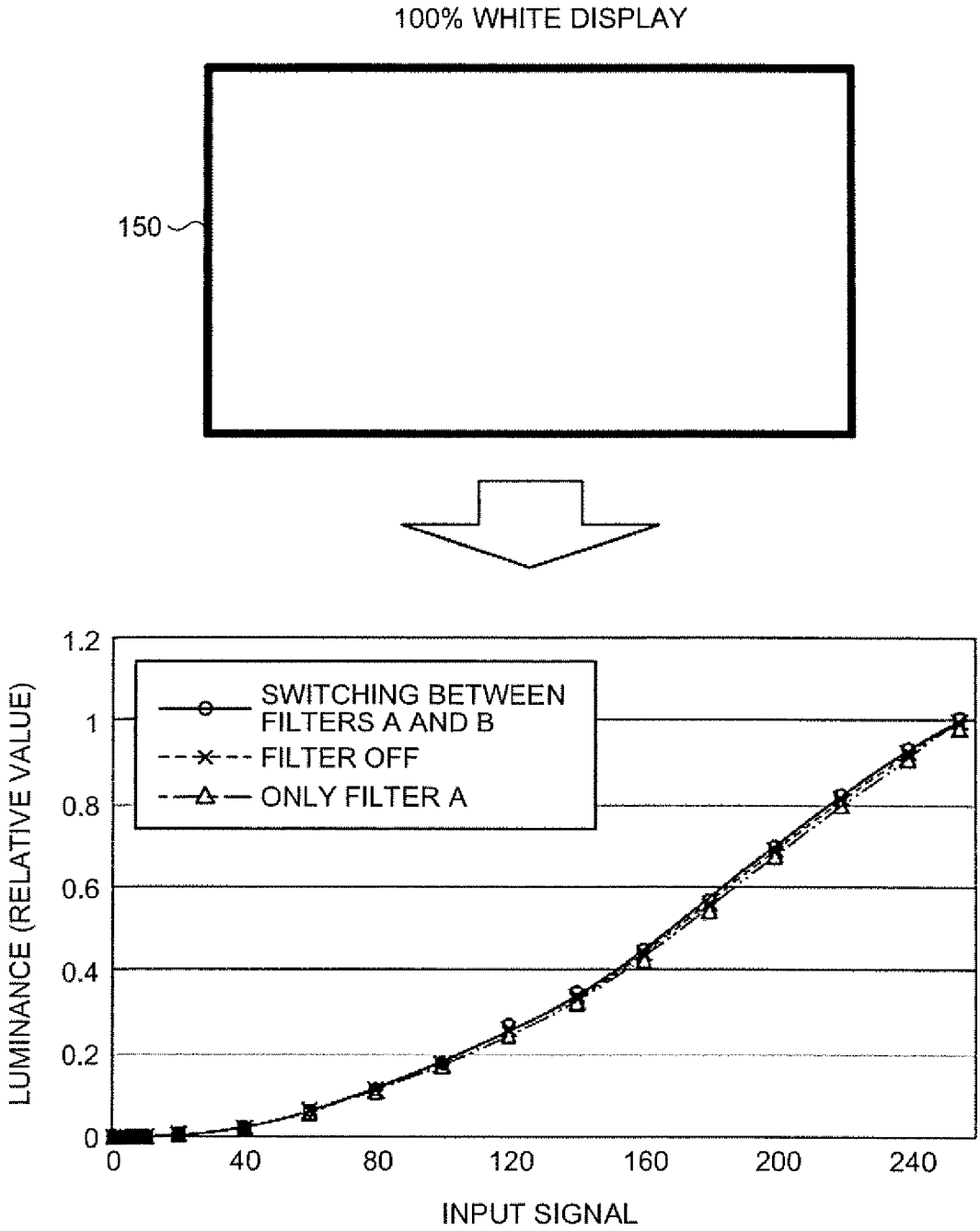
FIG. 8 is an exemplary graph comparing the luminance of the liquid crystal panel in 100% white display mode when selective switching is performed between the first spatial filter and the second spatial filter in the embodiment.

FIGS. 7 and 8 are graphs like that of FIG. 6 when filtering is performed by both the first spatial filter 111 and the second spatial filter 112 while selective switching is performed between the two. FIG. 7 is a graph comparing the luminance of the liquid crystal panel 150 in 1% white display mode (1% of the screen area displays a white portion), while FIG. 8 is a graph comparing the luminance of the liquid crystal panel 150 in 100% white display mode.

Although a description is given of selective switching of two filters, i.e., the first spatial filter 111 and the second spatial filter 112, in connection with FIGS. 7 and 8 by way of example, such selective switching can be performed among more than two filters.

An example of procedure for selecting one of the first spatial filter 111 and the second spatial filter 112 is explained below.

The comparator 113 compares the read light value La of the filter area 120 and the filtered light value Lb1 modified by filtering by the first spatial filter 111. If the filtered light value Lb1 is lower than the read light value La, the comparator 113 selects the second spatial filter 112 because the luminance will decrease by filtering. In other words, the comparator 113 sets the set light value Lc based on the filtered light value Lb2 modified by filtering by the second spatial filter 112.

If the filtered light value Lb1 is equal to or more than the read light value La, the comparator 113 selects the first spatial filter 111.

When, as illustrated in FIG. 7, display of a white portion occupies around 1% of the screen area, filtering with only the first spatial filter 111 generally decreases the luminance, thus causing luminance shortage. As a result, the white portion is displayed darker than before filtering.

Figure 9:
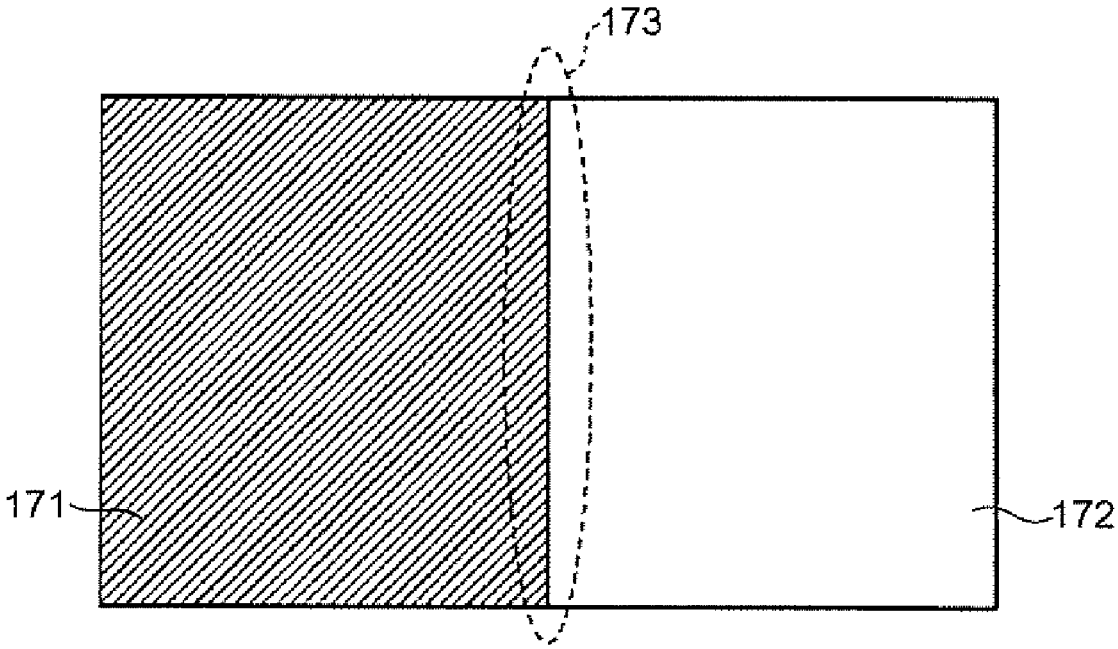
FIG. 9 is an exemplary schematic diagram of a video image containing a black portion and a white portion in equal measure in the embodiment.

However, by switching from the first spatial filter 111 to the second spatial filter 112, the luminance can be increased to a higher level than before filtering. Thus, the video image can be displayed at a desired luminance, with the white portion appearing even whiter. Further, in a video image as illustrated in FIG. 9 containing a black portion 171 and a white portion 172 of substantially the same size, a border area 173 between the black portion 171 and the white portion 172 is displayed with sharpness and clarity at a desired luminance.

When the entire screen is white, by filter switching, the luminance change is similar to that when filtering is performed by the first spatial filter 111 or when no filtering is performed. Thus, wasteful power consumption can be avoided.

While certain embodiments of the inventions have been described, these embodiments have been presented by way of example only, and are not intended to limit the scope of the inventions. Indeed, the novel methods and systems described herein may be embodied in a variety of other forms; furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

What is claimed is:

1. A light-emission control device that controls light emission of a plurality of light sources of a light emitter that illuminates a liquid crystal panel, the light emitter including a plurality of light source areas in each of which is arranged one of the light sources, the light-emission control device comprising:

a light-value calculator configured to calculate a light value of each of the light sources for each of the light source areas;

a light-value modifying module configured to modify a light value calculated by the light-value calculator for a target area to a modified light value using light values for surrounding areas, the target area being one of the light source areas for which a light value is to be modified, and the surrounding areas being light source areas around the target area; and a light controller configured to light a light source in the target area based on the modified light value, wherein the light-value modifying module includes a light-value reader configured to read the light value calculated by the light-value calculator for each of the light source areas, a filter configured to perform filtering on light values for the target area and the surrounding areas read as a read light value by the light-value reader to output a filtered light value, a comparator configured to compare the read light value and the filtered light value output from the filter, and a light-value setting module configured to set the modified light value based on a comparison result of the comparator.

2. The light-emission control device according to claim 1, wherein the comparator outputs a larger one of the read light value and the filtered light value to the light-value setting module.

3. The light-emission control device according to claim 2, wherein the filter includes a plurality of spatial filters with different gains to perform filtering on the read light value, and outputs filtered light values obtained by filtering with the spatial filters.

4. The light-emission control device according to claim 3, wherein the comparator selects any one of the spatial filters, and compares the read light value and a filtered light value obtained by filtering with the selected spatial filter.

5. The light-emission control device according to claim 3, wherein the spatial filters includes a first spatial filter having a gain characteristic of 1.0, and a second spatial filter having a gain characteristic of more than 1.0, the comparator outputs, when a first filtered light value obtained by filtering with the first spatial filter is equal to or more than the read light value, the first filtered light value to the light-value setting module, and the comparator outputs, when the first filtered light value is less than the read light value, a second filtered light value obtained by filtering with the second spatial filter to the light-value setting module.

6. The light-emission control device according to claim 1, further comprising:

a storage module configured to store therein an input video signal for each frame;

a corrector configured to correct the video signal stored in the storage module based on the modified light value and outputs a corrected video signal; and a liquid-crystal controller configured to control the liquid crystal panel based on the corrected video signal.

7. A liquid-crystal display apparatus including a liquid crystal panel, a light emitter that includes a plurality of light source areas in each of which is arranged one of a plurality of light sources for illuminating the liquid crystal panel, and a light-emission control device that controls light emission of the light sources, the liquid-crystal display apparatus comprising:

a light-value calculator configured to calculate a light value of each of the light sources for each of the light source areas;

a light-value modifying module configured to modify a light value calculated by the light-value calculator for a target area to a modified light value using light values for surrounding areas, the target area being one of the light source areas for which a light value is to be modified, and the surrounding areas being light source areas around the target area; and a light controller configured to light a light source in the target area based on the modified light value, wherein, the light-value modifying module includes a light-value reader configured to read the light value calculated by the light-value calculator for each of the light source areas, a filter configured to perform filtering on light values for the target area and the surrounding areas read as a read light value by the light-value reader to output a filtered light value, a comparator configured to compare the read light value and the filtered light value output from the filter, and a light-value setting module configured to set the modified light value based on a comparison result of the comparator.

8. A device that controls light emission from a light source of a light emitter that partially illuminates a liquid crystal panel, the light emitter including a plurality of light source areas each including a light source, the device comprising:

a light-value modifying module configured to modify a light value for a target area to a modified light value using light values for surrounding areas, the target area being one of the plurality of light source areas for which a light value is to be modified, and the surrounding areas being light source areas around the target area; and a light controller configured to illuminate a light source in the target area based on the modified light value, wherein the light-value modifying module includes a light-value reader configured to read the light value for the plurality of light source areas and output a read light value, a filter configured to perform filtering on light values for the target area and the surrounding areas received from the light-value reader and output a filtered light value, a comparator configured to compare the read light value and the filtered light value output from the filter, and a light-value setting module configured to set the modified light value based on a comparison result of the comparator.

9. The device according to claim 8 further comprising:

a light-value calculator coupled to the light-value modifying module, the light-value calculator to calculate light values for each light source in the plurality of light source areas based on an input video signal.

10. The device according to claim 8 further comprising:

a frame memory to store the input video signal.

11. The device according to claim 10 further comprising:

an input-signal corrector that corrects the input video signal from the frame memory based at least in part on the modified light value.

* * * * *